US005317786A

United States Patent [19]

Oexler et al.

[11] Patent Number: 5,317,786

[45] Date of Patent: Jun. 7, 1994

[54] ROTARY PLATE WITH CONTINUOUSLY CURVED SLIVER DEPOSITING CHANNEL

[75] Inventors: Rudolf Oexler; Friedrich Hauner; Kurt Inderst, all of Ingolstadt, Fed. Rep. of Germany

[73] Assignee: Rieter Ingolstadt Spinnereimaschinenbau AG, Ingolstadt, Fed. Rep. of Germany

[21] Appl. No.: 947,345

[22] Filed: Sep. 18, 1992

[30] Foreign Application Priority Data

Sep. 19, 1991 [DE] Fed. Rep. of Germany ..... 4131134

[51] Int. Cl.[5] ..... B65H 54/80; D01G 27/00

[52] U.S. Cl. ..... 19/159 R

[58] Field of Search ..... 19/157, 159 R; 57/90; 138/177, DIG. 8, DIG. 11

[56] References Cited

U.S. PATENT DOCUMENTS

| | | | |
|---|---|---|---|
| 3,105,996 | 10/1963 | Naegeli | 19/159 R |
| 3,141,201 | 7/1964 | Gasser | 19/159 R |
| 4,223,422 | 9/1980 | Weber | 19/159 R |
| 4,318,206 | 3/1982 | Ferri et al. | 19/159 R |
| 4,646,390 | 3/1987 | Bothner | 19/159 R |
| 4,691,414 | 9/1987 | Kluttermann | 19/159 R |
| 4,905,352 | 3/1990 | Günkinger et al. | 19/159 R |

FOREIGN PATENT DOCUMENTS

| | | | |
|---|---|---|---|
| 1115622 | 10/1961 | Fed. Rep. of Germany . | |
| 1115623 | 10/1961 | Fed. Rep. of Germany | 19/159 R |
| 1209030 | 1/1966 | Fed. Rep. of Germany | 19/159 R |
| 1510310 | 2/1970 | Fed. Rep. of Germany . | |
| 3118968 | 12/1982 | Fed. Rep. of Germany | 19/159 R |
| 3407135 | 8/1985 | Fed. Rep. of Germany | 19/159 R |
| 0272159 | 8/1964 | Netherlands | 19/159 R |

*Primary Examiner*—Clifford D. Crowder
*Assistant Examiner*—Ismael Izaguirre
*Attorney, Agent, or Firm*—Dority & Manning

[57] ABSTRACT

A rotary plate is provided for fiber sliver depositing devices, in particular for draw frames and carding machines. The plate includes a spatially curved sliver channel made of a pipe element with two arcs of circles verging directly into each other. The sliver channel of the rotary plate is preferably made of special friction reducing steel. The plate may also include a cover attached to the bottom thereof also formed of the friction reducing material.

11 Claims, 4 Drawing Sheets

FIG. 6
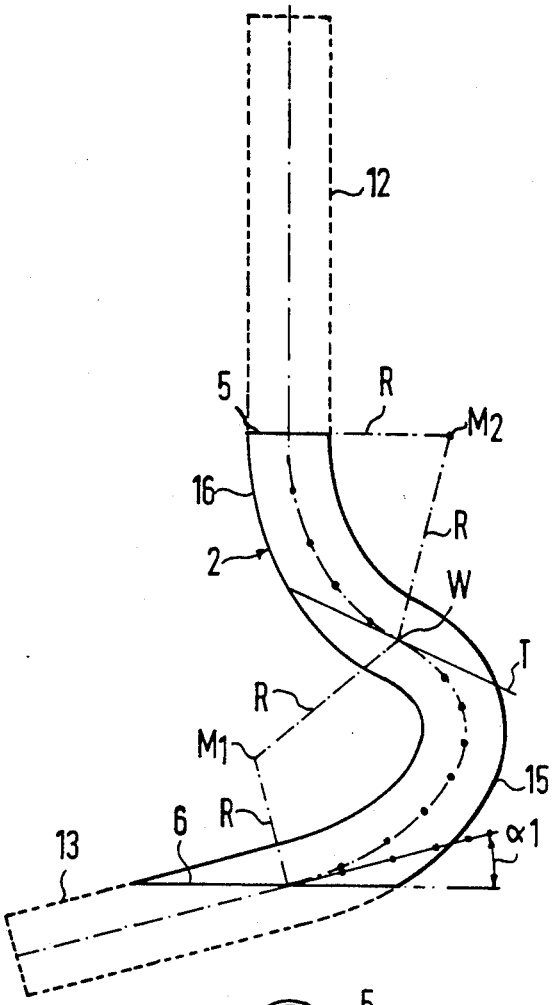
FIG. 7
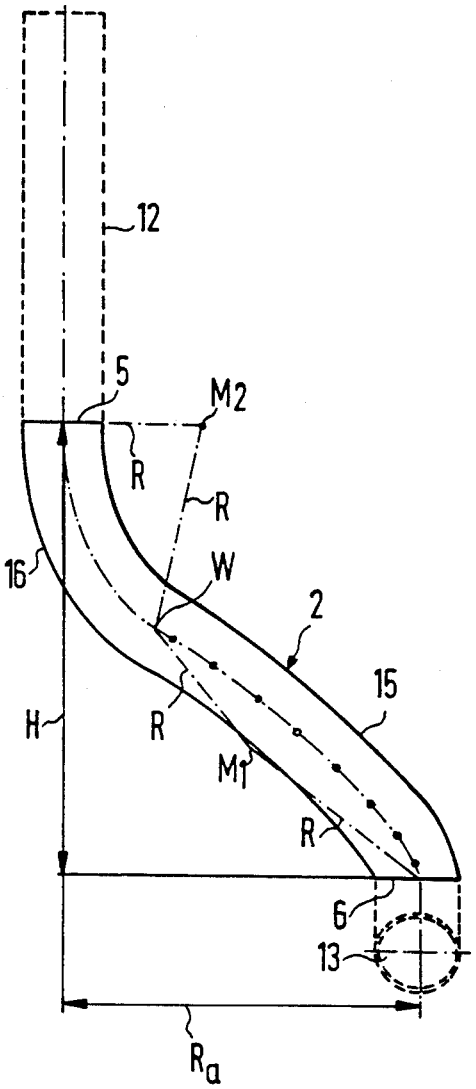
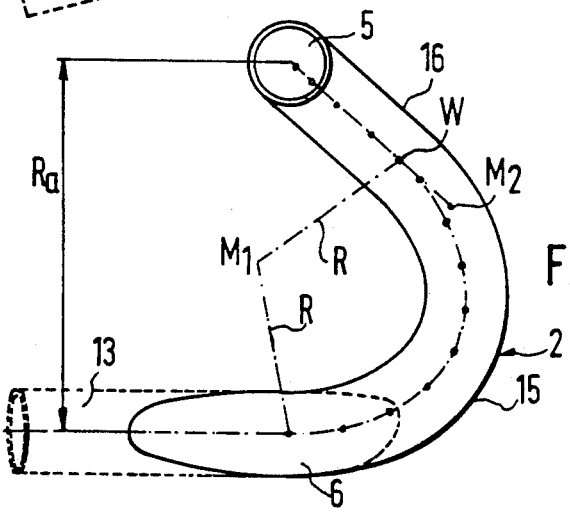
FIG. 8

ROTARY PLATE WITH CONTINUOUSLY CURVED SLIVER DEPOSITING CHANNEL

BACKGROUND OF THE INVENTION

The instant invention relates to a rotary plate for fiber sliver depositing devices with a sliver channel.

DE-PS 15 10 310 describes a rotary plate for depositing fiber slivers in spinning cans with a channel guiding the fiber sliver from an inlet element letting out at the top and in the rotational axis of the rotary plate via a curve in the form of an arc to an outlet element which is tangential to the rotary plate and letting out approximately at its circumference. Between its inlet element and its outlet element, the channel is provided with a straight and radially extending intermediate piece. It has been shown that such channels lead to poor and uneven fiber sliver deposit, especially in modern, very rapidly running machines equipped with such rotary plates.

DE-PS 11 15 623 further discloses that the channel is made up telescopically of at least two pipe bends in the form of arcs of circle. The course of the channel can be adapted to the different can diameters by means of the telescope-like construction of the pipe bends. The two pipe bends are provided with straight ends at their connection point. Aside from the disadvantage of a channel element extending in a straight line as in the above-mentioned DE PS 15 10 310, this device has the additional disadvantage that the fiber sliver must be led over the edge of a pipe bend and goes through a changed channel profile. Especially with rapid machines, such a design is not very conducive to great precision in the deposit of the fiber sliver and for careful handling of the fiber sliver. Deposits may form at the edge of the device and become detached from time to time so that they lead to irregularities in the fiber sliver.

OBJECTS AND SUMMARY OF THE INVENTION

It is therefore a principle object of the instant invention to ensure an extremely uniform and fiber-protecting sliver deposit, especially with rapid devices, for the deposit of fiber slivers in spinning cans by means of an appropriate design of the rotary plate and of the sliver channel.

Additional objects and advantages of the invention will be set forth in part in the description which follows, and in part will be obvious from the description, or may be learned by practice of the invention.

The objects are attained by the rotary plate of the present invention. If the sliver channel is formed of one pipe element with two arcs of circle going directly one into the other, only low acceleration forces act upon the fiber sliver. Due to the fact that no straight piece is inserted between the arcs of circle the fiber sliver is conveyed gently in the sliver channel so that practically no permanent deformation of the fiber sliver can be found after deposit in the spinning can. This uniform and gentle deposit of the fiber sliver is of great importance in modern high-precision and rapid draw frames and carding machines so that the previously produced, precise fiber sliver may not be destroyed again as it is being deposited in the cans.

In a preferred embodiment, the two arcs of circle have essentially the same radius. This is a positive factor in the acceleration of the fiber sliver since the fiber sliver is wound in large radii in this case so that minimal deflection forces act upon the fiber sliver.

If the two arcs of circle have a common tangent at their point of transition into each other, constant and edge-free transition of the arcs of circle is ensured.

It has been shown to be advantageous to fiber sliver deposit if the sliver channel consists exclusively of arcs of circle. The outlet of the sliver channel is advantageously formed as an arc of circle to achieve constraint-free fiber sliver deposit.

An angle of 130° of the plane in which the arcs of circles are located has been shown to be advantageous. The transition of the sliver channel into a horizontal plane takes place preferably at a depositing angle of approximately 15°.

In a further advantageous embodiment of the device according to the invention, the sliver channel and/or a cover of the rotary plate is made of special steel. Lower friction values of the fiber sliver are thus achieved so that the wear of the rotary plate and of the sliver channel, as well as damage to the fiber sliver, are advantageously reduced.

The accompanying drawings constitute a part of this specification and illustrate embodiments of the invention and, together with the description, serve to explain the principles of the invention.

BRIEF DESCRIPTION OF THE DRAWINGS

FIGS. 6 to 8 are partial perspective and diagrammatic views of the sliver channel.

DETAILED DESCRIPTION OF THE PREFERRED EMBODIMENTS

Figure 1:
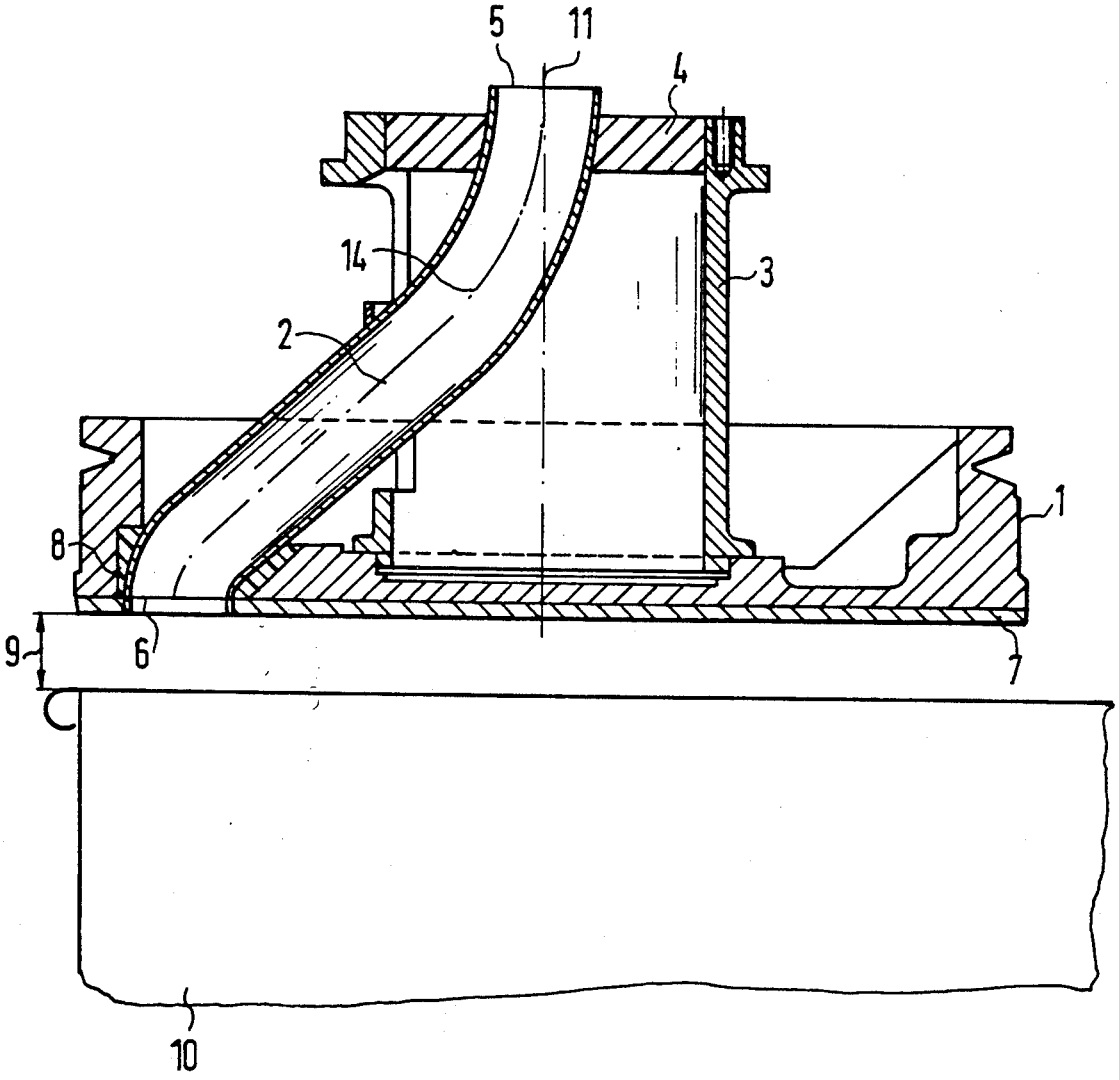
FIG. 1 shows a rotary plate and a spinning can in longitudinal section.

Reference will now be made in detail to the presently preferred embodiments of the invention. Each example is provided by way of explanation of the invention, not limitation of the invention. In fact, it will be apparent to those skilled in the art that various modifications and variations can be made in the invention without departing from the scope or spirit of the invention. Thus, it is intended that the present invention cover such modifications and variations. The numbering of components in the drawings is consistent throughout the application, with the same components having the same number in each of the drawings.

FIG. 1 shows a section through a rotary plate 1 with a sliver channel 2. The fiber sliver enters the sliver channel 2 in an inlet 5, runs through the sliver channel 2 and emerges again from sliver channel 2 at an outlet 6. The inlet 5 of the sliver channel 2 is located centrally in the rotary plate 1. A cast mass 4 connects the sliver channel 2 to a plate holder 3. This ensures that the sliver channel 2 is always positioned correctly and that its position does not change under outside influences. The fiber channel 2 is also fastened at its outlet 6 by means of a cast mass 8. The cast mass 8 ensures that a gap-free transition exists at the underside of the rotary plate 1 between the sliver channel 2 and the rotary plate 1. In an embodiment according to the invention the underside of the rotary plate 1 is provided with a cover 7. The cover 7 is advantageously made of special steel. This ensures that between a fiber sliver deposited in a spinning can 10 and the underside of the rotary plate 1, only minimal friction and little wear occur. In addition costly machining of the bottom of the rotary plate 1, in particular grinding and spatting of the cast aluminum part of the rotary plate 1 is avoided. Also, less care is required in sealing the sliver channel 2 with the cast mass 8 into the rotary plate 8.

A distance 9 between the rotary plate 1 and the spinning can 10 depends on the fiber sliver depositing device and spinning can 10. The device according to the instant invention advantageously ensures that no fiber sliver is hurled over the spinning can edge during deposit when the distance 9 is great. The fiber sliver is rather deposited into spinning can 10 without significant radial speed components. As a result, especially uniform and orderly deposit of the fiber sliver is ensured. Furthermore, the orderly deposit also ensures good draw-off of the fiber sliver from can 10. This is especially effective at high delivery speeds. It has been observed with known devices that fiber slivers are hurtled out of the spinning can, particularly in the first fiber sliver layers deposited in the spinning can 10.

A rotational axis 11 of the rotary plate 1 is a tangent at the inlet arc of sliver channel 2. The rotation of the rotary plate 1 and the can 10 produces a cycloid-shaped deposit of the fiber sliver in spinning can 10. A center line 14 of the sliver channel 2 extends from the rotational axis 11 at the inlet 5 of the sliver channel 2 to the outlet 6 and essentially delineates the deformation of the fiber sliver as it runs through the sliver channel 2.

Figure 2:
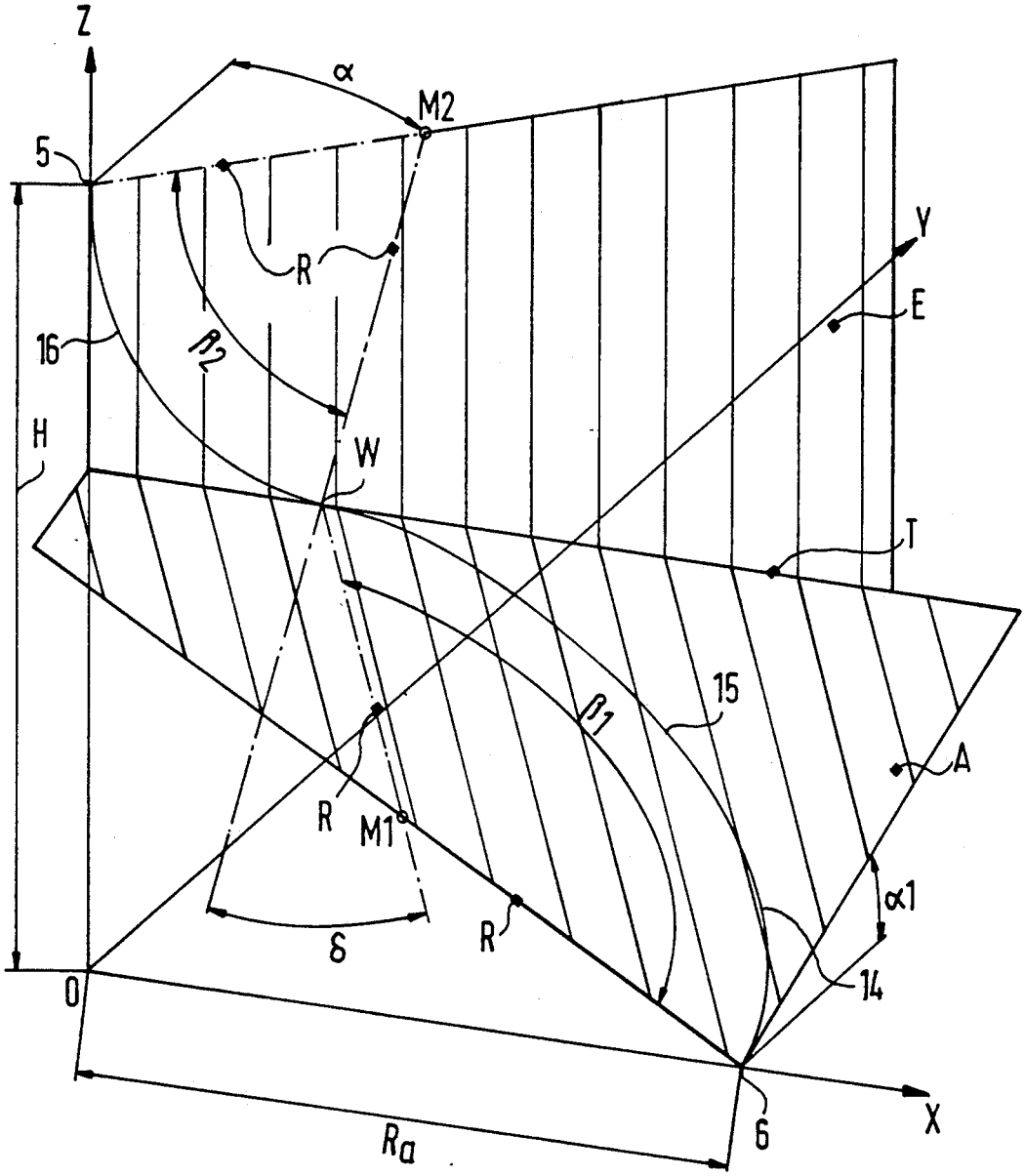
FIG. 2 is a diagrammatic representation of the sliver channel plane.

In FIG. 2 the center line 14 of the sliver channel 2 is shown in an XYZ coordinate system. The coordinate system is organized here so that the inlet 5 has X and Y zero values and the outlet 6 has Y and Z zero values. The center line 14 comprises two arcs of circles. The first arc of circle has a central point Ml and represents the outlet arc. The inlet arc has its center at a central point M2. Both arcs have the same radius R. In an advantageous embodiment of the invention the fiber sliver is subjected to minimal load as it runs through the sliver channel 2, thanks to the identical radius R. The radius should be as large as possible so that a uniform force may be exerted upon the fiber sliver during its entire run through the sliver channel 2. In order to obtain the largest possible radii R it is an advantage according to the invention for the arcs of circle laid around the central points M1 and M2 to continue directly into each other. The arcs of circle have therefore a common tangent T at a turning point W. The end of the outlet arc 15 is determined by a fixed depositing radius Ra with a depositing angle $\alpha 1$ of the outlet tangent to the rotary plate floor surface which is equal to the Y axis of the coordinate system and by the height H of the sliver channel 2. In order to achieve these predetermined geometric dimensions, a plane E in which the inlet arc 16 is located is inclined towards a plane A in which the outlet arc 15 is located at an angle $\delta$. For a space-saving installation of the rotary plate 1 in the fiber sliver depositing device it has been shown to be advantageous for the inlet arc 16 to be shorter than the outlet arc 15. The inclination of plane E at an angle $\alpha$ in relation to the Y axis ensures a shorter travel distance through the sliver channel 2 with minimum fiber sliver acceleration.

Figure 3:
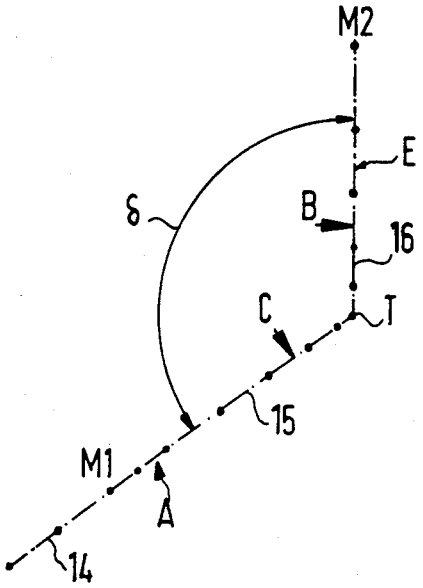
FIGS. 3 to 5 are diagrammatic representations of the course of the median line of the sliver channel.
Figure 4:
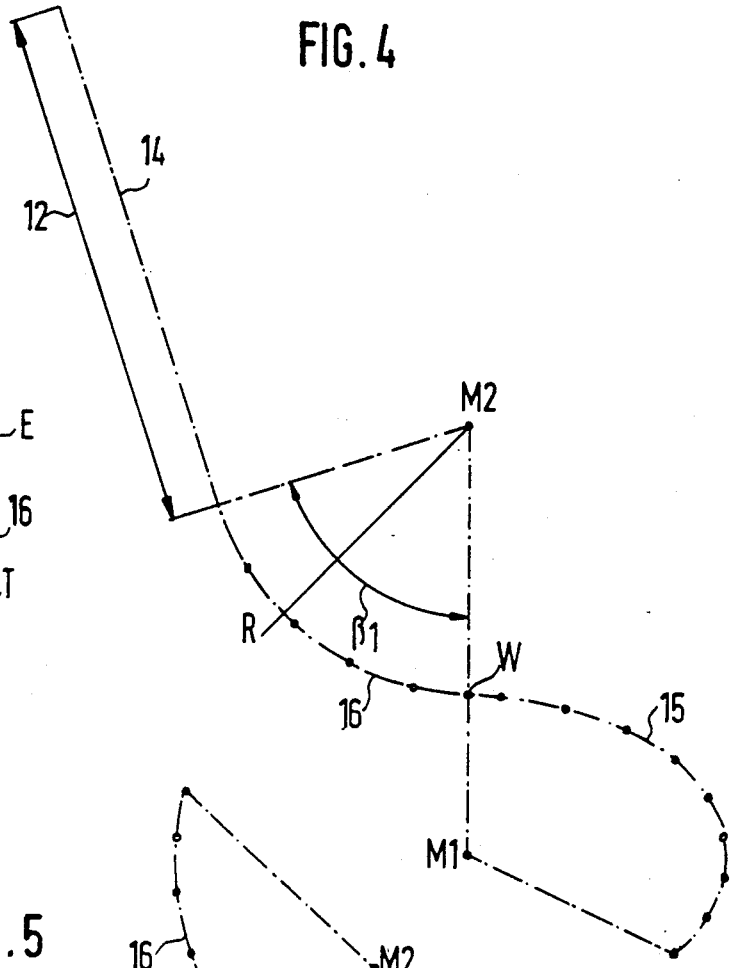

FIG. 3 shows the inclination of plane E of the inlet arc 16 in relation to plane A of the outlet arc 15. The angle of inclination $\delta$ in the embodiment shown is approximately 125°. Planes E and A intersect in tangent T. The central points Ml and M2 of the two arcs of circle of the sliver channel 2 are also located in plane A or plane E. A view B of FIG. 3 is shown in FIG. 4. FIG. 4 shows a drawing of the center line 14 of the sliver channel in which the inlet arc 16 is shown without distortion. The inlet arc 16 has a radius R around central point M2. In this embodiment the inlet arc 16 extends over an angle which in this case is approximately 70°. The outlet arc 15 surrounding central point Ml is shown with distortion in FIG. 4 because of the inclination of plane A in relation to plane E. FIG. 4 shows a straight piece 12 before the inlet arc 16 in addition to the outlet arc 15 and the inlet arc 16. The straight piece 12 is provided for the semi-finished product for reasons of production engineering. A precise curve of arcs 15 and 16 within tolerances is thereby assured, since the work piece can be clamped into a bending device. The straight piece 12 is removed from arcs 15 and 16 as the sliver channel 2 is completed. By deburring the inlet 5, low-friction introduction of the fiber sliver into the sliver channel 2 is assured.

Figure 5:
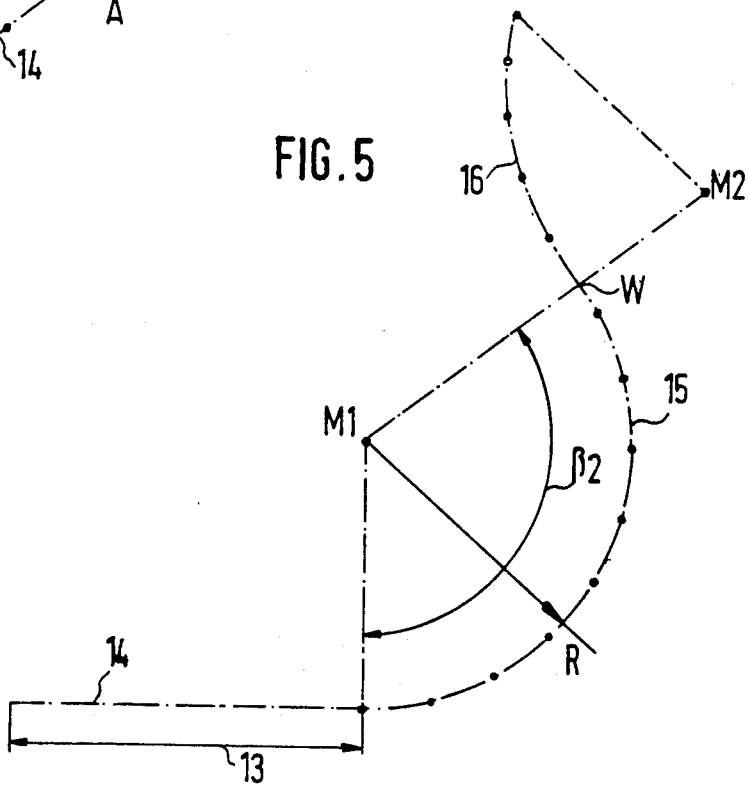

FIG. 5 shows a view of FIG. 3 in the direction of arrow C. In FIG. 5 the outlet arc 15 is shown without distortion. The center line 14 of sliver channel 2 has a radius R in the outlet arc 15 and central point M1. Inlet arc 16 verges directly into outlet arc 15 at the turning point W. In the embodiment shown the outlet arc 15 has an angle 2 of approximately 127°. For reasons of production engineering a straight piece 13 is installed in the semi-finished product following the outlet arc 15. Just as in the case of the straight piece 12 on the inlet arc 16, the straight piece 13 on the outlet arc 15 ensures secure clamping of the pipe which is preferably made of special steel and which is used to constitute the sliver channel 2 in the plying device. The straight piece 13 is removed as the sliver channel 2 is completed. The end of outlet arc 15 is preferably deburred.

FIG. 6 shows a sliver channel 2 in a view that is radial to the rotary plate 11. The straight pieces 12 and 13 which are removed in the finished product are indicated by broken lines. FIG. 6 clearly shows that the inlet arc 16 and the outlet arc 15 form a common tangent T at the turning point W. Inlet arc 16 as well as outlet arc 15 have the same curve radius R. This has proven to be especially advantageous as the acceleration forces acting upon the fiber sliver are especially uniform as a result. An orderly transfer of the fiber sliver is thus achieved without any change of the fiber sliver as it is being deposited from its state when it entered the sliver channel 2. The outlet 6 is designed so that it is even with the bottom of the rotary plate 1. The outlet arc 15 enters the floor of rotary plate 2 under a depositing angle $\alpha 1$. A depositing angle of 155° has proven to be advantageous for draft-free deposit of the fiber sliver. In the shown embodiment a radius R of approximately 80 mm has proven to be especially gentle for the fiber sliver.

FIG. 7 shows a drawing of the sliver channel 2 in the direction of the rotary plate 1. Here too the direct verging of the inlet arc 16 into the outlet arc 15 is shown at turning point W. Height H of the sliver channel 2 is determined by the construction of the fiber sliver depositing device. The selection of the arcs of circles used for the inlet arc 16 and the outlet arc 15 as well as of the inclination of planes B and A with respect to each other are dictated by this height H and by an additional predetermined depositing radius Ra.

FIG. 8 shows a view in axial direction of the rotary plate on the sliver channel 2. In the drawing in FIG. 8 it can be seen clearly that a round pipe was used as the basic material in the shown embodiment. According to the invention it is however possible to use different cross-sections for the fiber sliver. In the shown embodiment the depositing radius Ra is approximately 140 mm. This has proven to be advantageous in the depositing of fiber slivers in spinning cans 10 having a diameter of 450 mm. As a result draft-free deposit of the fiber sliver and optimal filling of the spinning can 10 with fiber sliver are ensured.

This invention is not limited to the embodiments shown, but is intended to cover modifications and variations within the scope of the appended claims.

We claim:

1. A rotary plate for use with fiber sliver depositing device, said rotary plate comprising an inlet and an outlet, a substantially flat underside having said outlet defined therein, and a spatially continuously curved sliver channel defined therethrough, said channel comprising a pipe element defined by a first arc starting at said inlet, and a second arc merging directly from said first arc and ending at said outlet so that there is no straight component of said pipe element between said inlet and said outlet.

2. The rotary plate as in claim 1, wherein said first arc and said second arc have substantially the same radius.

3. The rotary plate as in claim 1, wherein said first arc is defined in a first plane and said second arc is defined in a second plane which is at an angle to said first plane.

4. The rotary plate as in claim 1, wherein said sliver channel is flush with the underside of said rotary plate and defines a depositing angle relative to the underside of said rotary plate.

5. The rotary plate as in claim 4, wherein said depositing angle is approximately 15 degrees.

6. The rotary plate as in claim 1, wherein said rotary plate is formed of a steel having low friction characteristics.

7. The rotary plate as in claim 1, further comprising a cover attached to said underside, said cover being formed of a friction reducing material to minimize friction between sliver deposited from said rotary plate and said underside.

8. A rotary plate for depositing fibre sliver into sliver cans, said rotary plate comprising:

a substantially horizontal inlet and a substantially horizontal outlet;

a continuously radial and non-horizontal sliver channel defined between said inlet and said outlet, said sliver channel formed from a pipe element having a first constant radius arc section disposed in a first plane, and a second constant radius arc section disposed in a second plane, said first section and said second section having substantially equal radii, said first plane forming an angle with said second plane of at least 100 degrees, said second arc section forming a depositing angle of at least 10 degrees with said horizontal outlet; and a continuously radial transition point between said first arc section and said second arc section whereby said sections share a common tangent at said transition point.

9. The rotary plate as in claim 8, wherein said sliver channel is comprised substantially entirely of said first arc section and said second arc section.

10. The rotary plate as in claim 8, further comprising a cover formed of a friction reducing material attached to the bottom of said rotary plate, said horizontal outlet defined in said cover.

11. A rotary plate for use with fiber sliver depositing devices, said rotary plate comprising a substantially flat underside and a spatially continuously curved sliver channel defined therethrough, said channel comprising a pipe element defined by a first arc defined in a first plane, and a second arc defined in a second plane which is at an angle of approximately 130 degrees to said first plane, said second arc merging directly from said first arc so that there is no straight component of said pipe element between said first arc and said second arc.

* * * * *